US005714212A

United States Patent [19]

Nissim et al.

[11] Patent Number: 5,714,212

[45] Date of Patent: Feb. 3, 1998

[54] BALANCING JIGSAW PUZZLE SCULPTURE

[75] Inventors: Ofer Nissim, Pound Ridge, N.Y.; Trisha Sutherlan, Fairfield; Donald B. Ellingham, Greenwich, both of Conn.

[73] Assignee: AKK Foundation, LLC, Norwalk, Conn.

[21] Appl. No.: 599,549

[22] Filed: Dec. 19, 1995

[51] Int. Cl.[6] ..... B44C 3/06

[52] U.S. Cl. ..... 428/33; 52/311.2; 156/63; 273/157 R; 428/16; 446/325; 446/396

[58] Field of Search ..... 428/16, 33; 52/311.2; 273/157 R; 446/325, 396; 156/63

[56] References Cited

U.S. PATENT DOCUMENTS 2,242,631 5/1941 Stillman ..... 428/16 X 2,725,234 11/1955 Coble et al. ..... 428/16 X 3,301,725 1/1967 Frontera ..... 428/16 X 3,503,832 3/1970 Umminger, Jr. ..... 428/33

*Primary Examiner*—Henry F. Epstein

*Attorney, Agent, or Firm*—Patrick J. Walsh

[57] ABSTRACT

A jigsaw puzzle sculpture comprising a plurality of interlocking pieces with a suspension point which is oriented relative to the center of gravity of the assembled puzzle sculpture. The suspension point is provided for display of the figure on a display means such as a horizontal rod member, or vertical balancing point, thereby replicating the natural posture, position, stance or carriage of the replicated figure. In the preferred embodiment, the puzzle sculpture replicates a living or extinct creature, such as an exotic, endangered, or extinct bird, which perches on a branch in a natural position.

11 Claims, 7 Drawing Sheets

BALANCING JIGSAW PUZZLE SCULPTURE

FIELD OF THE INVENTION

This invention relates generally to a decorative three-dimensional jigsaw puzzle sculpture. More specifically, this invention relates to a jigsaw puzzle sculpture in which the center of gravity has been pre-determined thus allowing the assembled jigsaw puzzle sculpture to balance, or perch, on a horizontal rod, vertical balancing point, or similar device for viewing.

BACKGROUND OF THE INVENTION

Within the field of puzzles are many solid types, and most notable are the common table-top jigsaw puzzles. The name evolved from the most common method of fabrication to the present day punched-out cardboard types. Assembly costs of the ancestral wooden jigsaw puzzles is high due to the circuitous path the cutting blade of the jigsaw must follow, with thicker wood complicating the process substantially. The cost issue has led to the more common punched variety. A few substantially thick two-dimensional types are still made, as are three-dimensional wooden block puzzles.

Among the many types of existing puzzles there are three basic categories. The first is a jigsaw puzzle which consists of interlocking pieces which, when assembled, form a flat picture. The second category of puzzles form a two- or three-dimensional design. Meisser et al, U.S. Pat. No. 4,570,936; Foresse et al, U.S. Pat. No. 5,165,689, and Gallent, U.S. Pat. No. 5,251,900 are jigsaw puzzles which include a feature by which the completed jigsaw puzzle forms a three-dimensional figure. In Meisser, two or more completed puzzles, each containing open slots, are interfitted together to form a three-dimensional figure which is capable of being displayed on a flat surface, such as a table or shelf. The Foresse patent teaches the use of a three-dimensional form which retains two or more completed puzzles which, when fully assembled, provide a decorative piece of art capable of being displayed on a flat surface, such as a table. The three-dimensional puzzle disclosed in Gallent when assembled creates a self-standing, three-dimensional building structure. This is accomplished by first assembling the interlocking walls and then interlocking puzzle walls that are transverse to one another with complementary dovetail joints.

The third type of puzzle, the block puzzle, challenges the user's mental process to arrive at the correct solution to interconnect parts which fit together with mortised joints to form a pre-determined three-dimensional geometric figure. Dykstra, U.S. Pat. No. 5,040,797 and Embro, U.S. Pat. No. 5,405,135 are examples of block puzzle disclosures. Dykstra discloses a three-dimensional geometric puzzle which can be assembled into two distinct three-dimensional geometric figures in a variety of ways. The block puzzle disclosed in Embro is a cubic block which is assembled from interfitting puzzle pieces shaped like various letters of the alphabet and has at least one assembled condition wherein all of the pieces cooperate in interfitting relation to each other to form a cube.

The completed jigsaw puzzle must be displayed on a sizable horizontal flat surface, or by gluing the assembled puzzle onto a backing to display the puzzle vertically. The difficulty encountered in the past with three-dimensional puzzles was a means for displaying the completed puzzle in its natural form. The three-dimensional puzzle disclosed in Meisser allows the completed form of an animal to stand on its legs. A building structure disclosed in the Gallent patent when fully assembled creates a self-standing, three-dimensional building structure. The existing art is limited to depicting forms which naturally stand on a flat, horizontal surface. A natural perching place for a bird is on a branch or some other type of horizontal rod member; such perching cannot be accomplished in a puzzle utilizing the existing art.

Unlike the jigsaw and block puzzles previously discussed, the present invention utilizes the assembled puzzle sculpture's center of gravity to create a self-balancing, three-dimensional sculpture such as an exotic, endangered, or extinct bird. Determining the center of gravity for the puzzle is unique to the engineering and design of the puzzle and integral to its nature, thereby allowing the fully assembled sculpture to balance on a horizontal rod member resembling a branch or on a vertical balancing point. The interlocking puzzle pieces may be constructed of a substantially thick material which allows the pieces to be moved forward and backward to further enhance the three-dimensional effect.

SUMMARY OF THE INVENTION

This invention overcomes the aforementioned balancing problem in a jigsaw puzzle containing a plurality of releasable interlocking pieces by providing a suspension point relative to the completed puzzle sculpture's center of gravity, in that its assembled form will balance or perch on a display means, such as a vertical point, or horizontal rod member, thereby exhibiting the sculpture, such as an exotic, endangered or extinct bird, in its natural perching position.

It is an object of the present invention to provide a plurality of interlocking pieces which can be assembled into a pre-determined form, such as an exotic, endangered, or extinct bird. The puzzle is preferably made of wood or a wood composite material, however, other materials, such as a polymer resin or foam material, may also be used. The interlocking pieces of the jigsaw puzzle are flat, planar blocks which may be of substantial thickness to allow the individual pieces to slide forward and backward to produce a three-dimensional effect mimicking anatomical, functional, or characteristic segments of the replicated figure. In the preferred embodiment, the three-dimensional effect can be manipulated within anatomical segments, such as wing structure, feather variations, beak and feet manipulations and/or puffed chest.

Another embodiment of this invention is to place a suspension point at the center of a recess relative to the center of gravity of the completed jigsaw puzzle sculpture. In the preferred embodiment, the center of gravity is in a location below the center of a recess replicating the birds' claws, thus allowing the assembled form to naturally balance, or perch, on a horizontal rod member or vertical balancing point.

An alternative embodiment of the invention includes compressible inserts, such as felt and velour, which are adhesively attached on the inside mating surfaces of the puzzle pieces to provide a friction fit, thus preventing the pieces from dislodging unless a sufficient force is applied.

The novel features which characterize the invention are defined by the appended claims. The foregoing and other objects, advantages and features of the invention will hereinafter appear, and for the purpose of illustration of the invention, but not a limitation of, an explanatory embodiment is shown in the appended drawings. For the purposes of illustration, the Scarlet Macaw is shown as the preferred embodiment, intended for balancing on a horizontal rod member or branch. This is not intended to limit the scope of this invention to living or extinct creatures.

DETAILED DESCRIPTION OF THE PREFERRED EMBODIMENT

Figure 1:
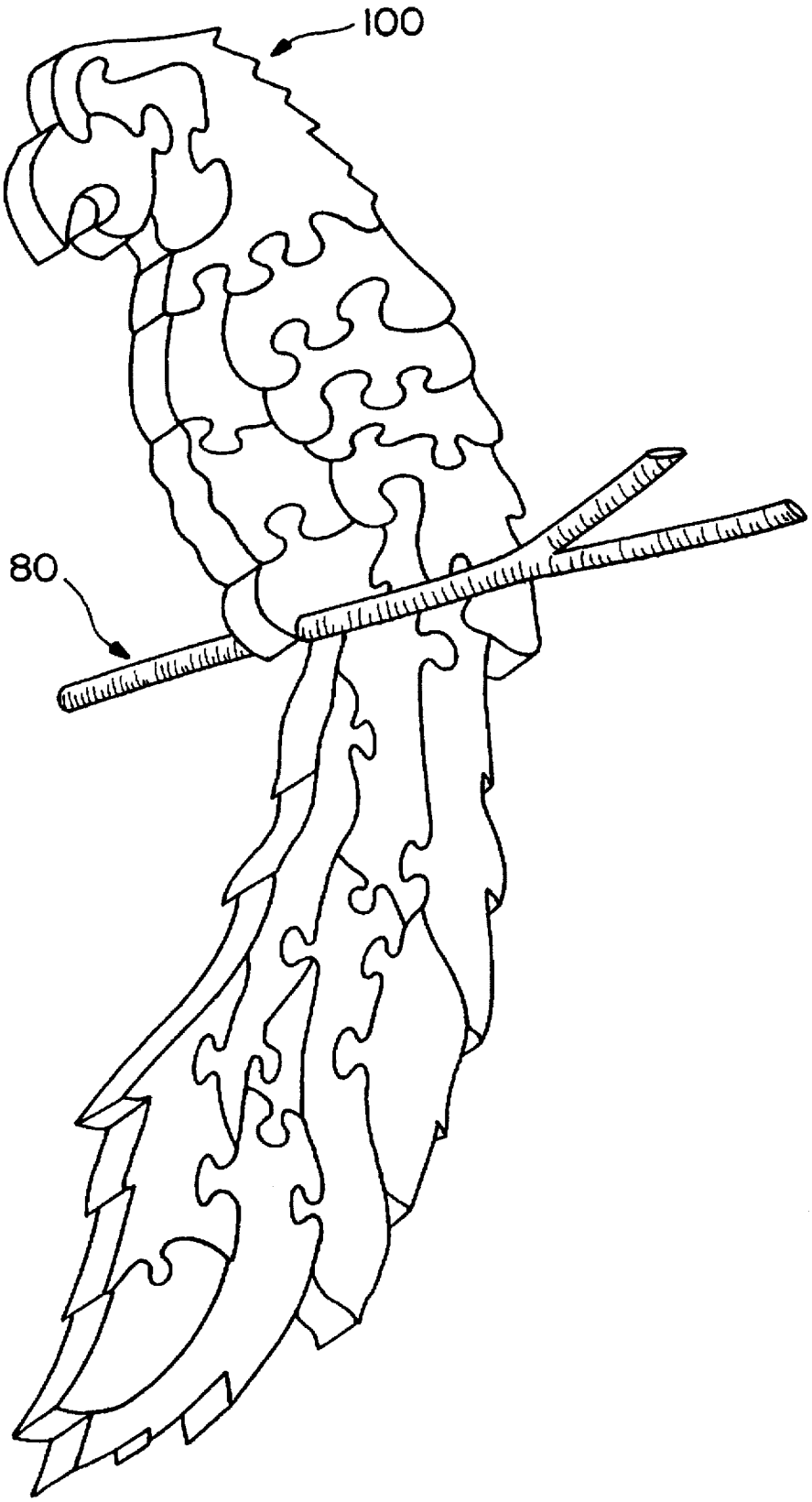
FIG. 1 is a front perspective view of a jigsaw puzzle sculpture perched on a horizontal rod member for viewing in accordance with a preferred embodiment of the invention.

FIG. 1 is a perspective view of a three-dimensional, self-balancing jigsaw puzzle sculpture 100 suspended on a horizontal rod member 80 in accordance with the preferred embodiment of the invention. The innovative feature of the assembled puzzle sculpture 100 is that the center of gravity is pre-determined to be in a place directly below the selected suspension point, allowing the sculpture 100 to balance on a horizontal rod member or vertical point. In the embodiment illustrated in FIG. 2, the puzzle pieces 12, 14, 16, etc. which provide the surface design and color are interconnected to form a pre-determined sculpture 100 of a Scarlet Macaw which balances on a horizontal rod member 80, however other figures which balance on a horizontal rod member or vertical balancing point could be used.

Figure 2:
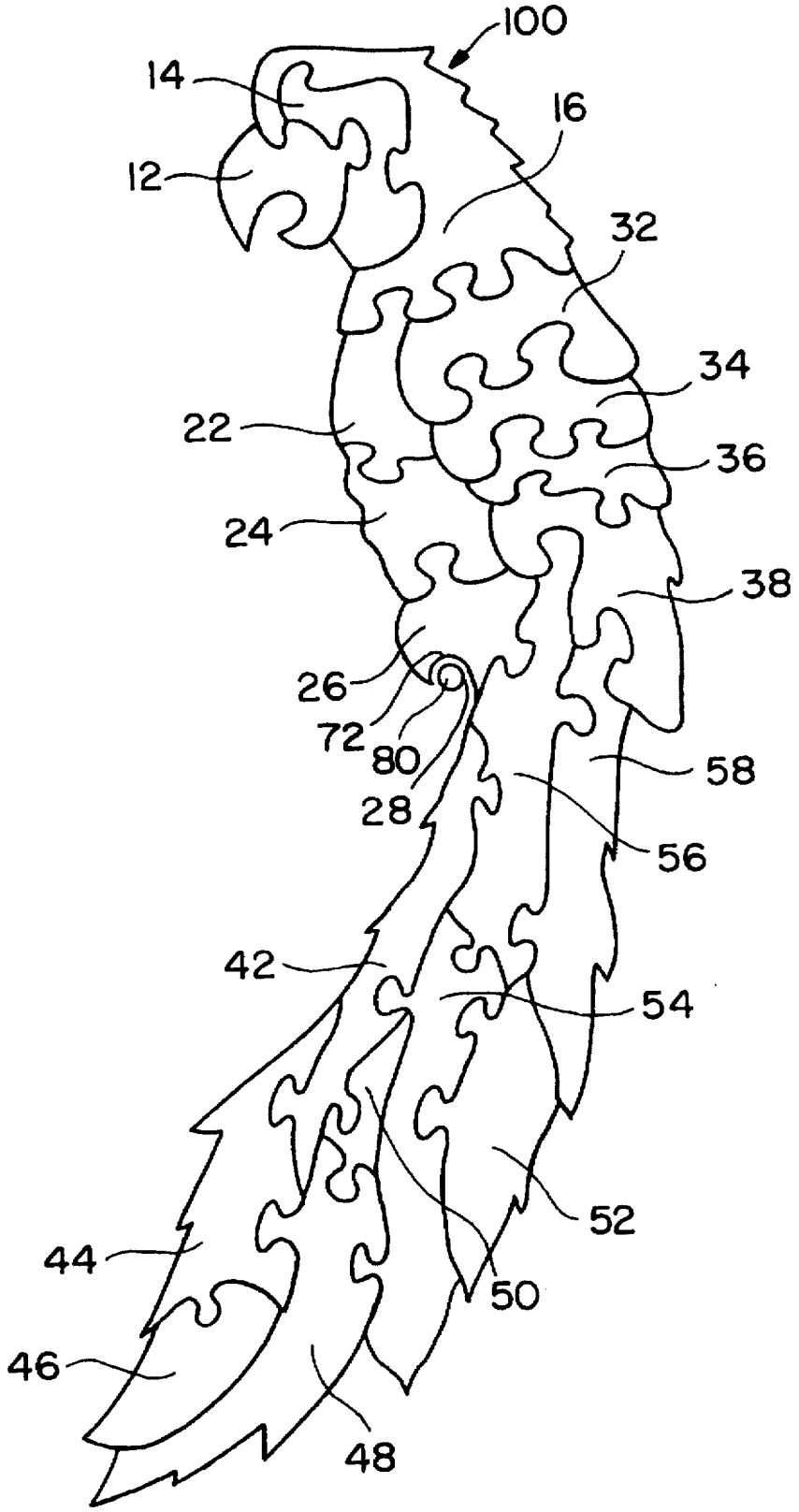
FIG. 2 is a front view of the puzzle pieces interlocked together to form a predetermined figure in accordance with the invention.

As shown in FIG. 2, the preferred embodiment includes a plurality of puzzle pieces 12, 14, 16, etc., which can be releasably interlocked to form the pre-determined sculpture 100. The suspension point 72 in the preferred embodiment of the invention is the claw 26 which represents the replicated bird's natural perching point. When the claw 26 of the assembled puzzle sculpture 100 is placed upon the horizontal rod member 80, the sculpture 100 balances on the horizontal rod member 80 as previously shown in FIG. 1. The suspension point 72 is located directly above the pre-determined center of gravity 70 (FIG. 6*b*). In the preferred embodiment, the assembled sculpture 100 represents a bird which is perched on a horizontal rod member 80 which represents a branch.

Figure 3:
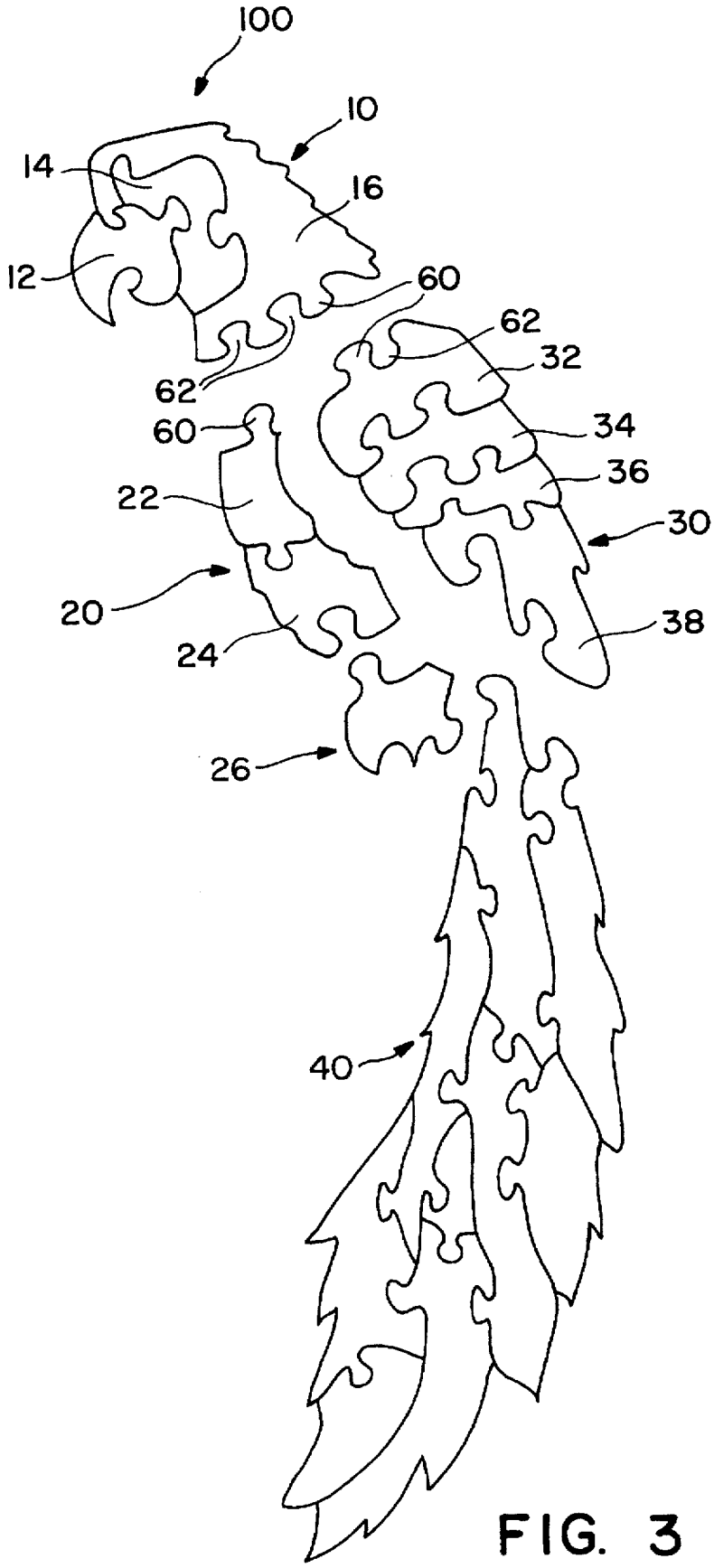
FIG. 3 is a plan view illustrating the interlocking puzzle pieces within various anatomical segments of the figure as an embodiment of the invention.

As shown in FIG. 3, each puzzle piece 12, 14, 16, etc., contains at least one male projection 60 or female recess 62. As an example, the puzzle piece 16 has two female recesses 62 which are correspondingly shaped to the male projections 60 of the adjacent puzzle pieces 22 and 32, and one male projection 60 of puzzle piece 16 which corresponds to the female recess 62 of the puzzle piece 32 to allow the pieces to interlock in a conventional manner.

As further illustrated in FIG. 3, the puzzle pieces 12, 14, 16, etc., which provide the overall surface design and color further correspond to body parts of the assembled puzzle sculpture's 100 overall characteristics. The assembled sculpture 100 shown in FIG. 3 consists of a head 10, a chest 20, a wing 30, a tail 40, and a claw 26, all of which interconnect to form peripheral edges that resemble the silhouette of the Scarlet Macaw. In the preferred embodiment of the invention, the puzzle pieces 12, 14, 16, etc., making up these anatomical parts of the bird further define the details within each part of the anatomy. The head 10 consists of puzzle pieces 12, 14, and 16 wherein piece 12 is the bill, piece 14 is the face, and piece 16 is the nape and crown of the bird. The chest 20 consists of two puzzle pieces 22 and 24 wherein piece 22 is the figure's breast and piece 24 is the figure's abdomen; the wing 30 consists of puzzle pieces 32, 34, 36 and 38 which are cut to resemble feathers in the preferred embodiment. In the preferred embodiment each piece is painted a color resembling the color of the actual bird's feathers at or near that location. For example, piece 32 is scarlet red, piece 34 is yellow, piece 36 is green and piece 38 is violet blue, which, when assembled, compare realistically with the actual species Scarlet Macaw's wing shape and coloring.

Figure 4A:
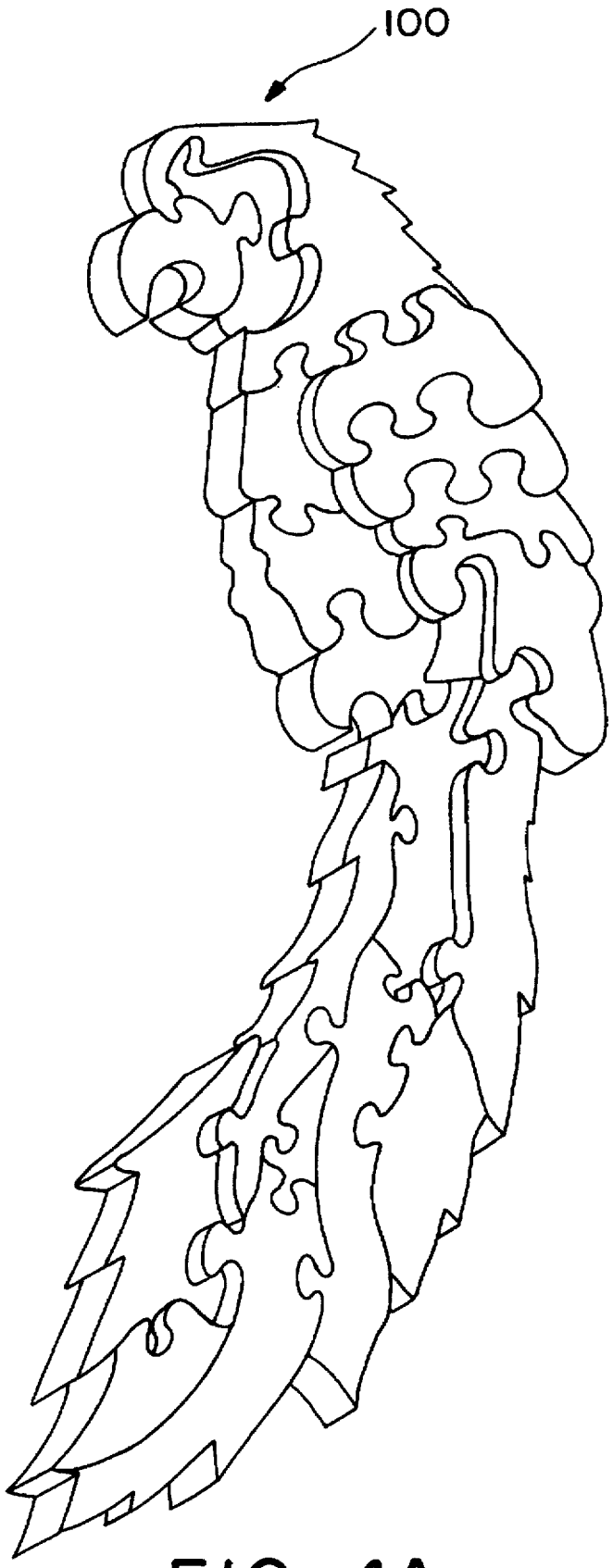
FIG. 4*a* is a perspective view of an embodiment of the jigsaw puzzle wherein a combination of pieces are moved forward or backward to produce an enhanced three-dimensional effect.
Figure 4B:
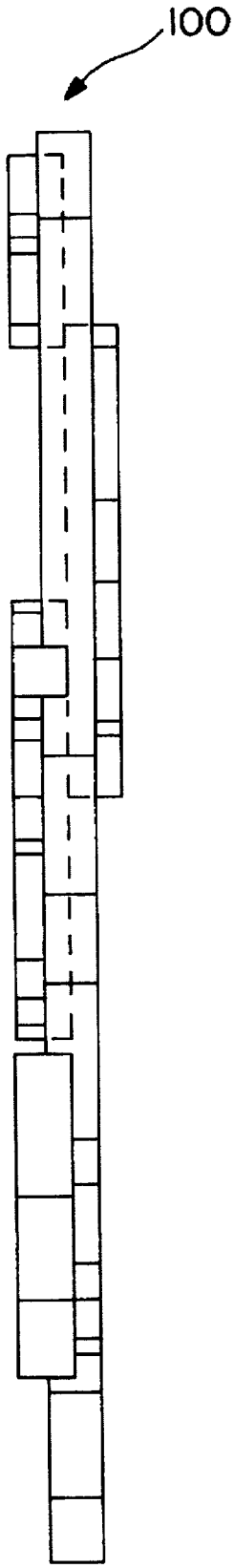
FIG. 4*b* is an edge view of the embodiment of the invention shown in FIG. 4*a* illustrating the resulting enhanced three-dimensional effect.

In an alternative embodiment of the invention, the puzzle pieces 12, 14, 16, etc., may be substantially thick to allow the pieces to be moved forward or backward in any combination, such as shown in FIGS. 4*a* and 4*b*, to produce an enhanced three-dimensional effect while maintaining the center of gravity 70 which allows the assembled puzzle sculpture 100 to balance on a horizontal rod member 80. In the preferred embodiment, the puzzle pieces 12, 14, 16, etc., are made of a wood or wood composite material, such as medium density fiberboard.

FIG. 4*a* illustrates various puzzle pieces moved forward and backward to further enhance three-dimensionality. FIG. 4*b* shows the pieces of the jigsaw puzzle displaced in FIG. 4*a* in an edge view of the completed jigsaw puzzle sculpture 100.

Figure 5B:
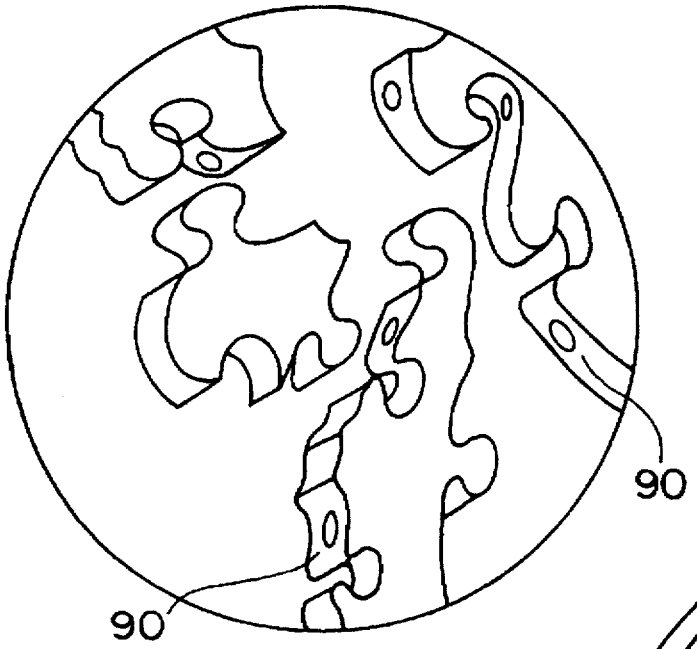
FIG. 5 is an exploded view of another embodiment of the jigsaw puzzle wherein compressible inserts are attached longitudinally to the inside mating surfaces of the puzzle pieces to provide a friction fit between the interlocking puzzle pieces.
Figure 5A:
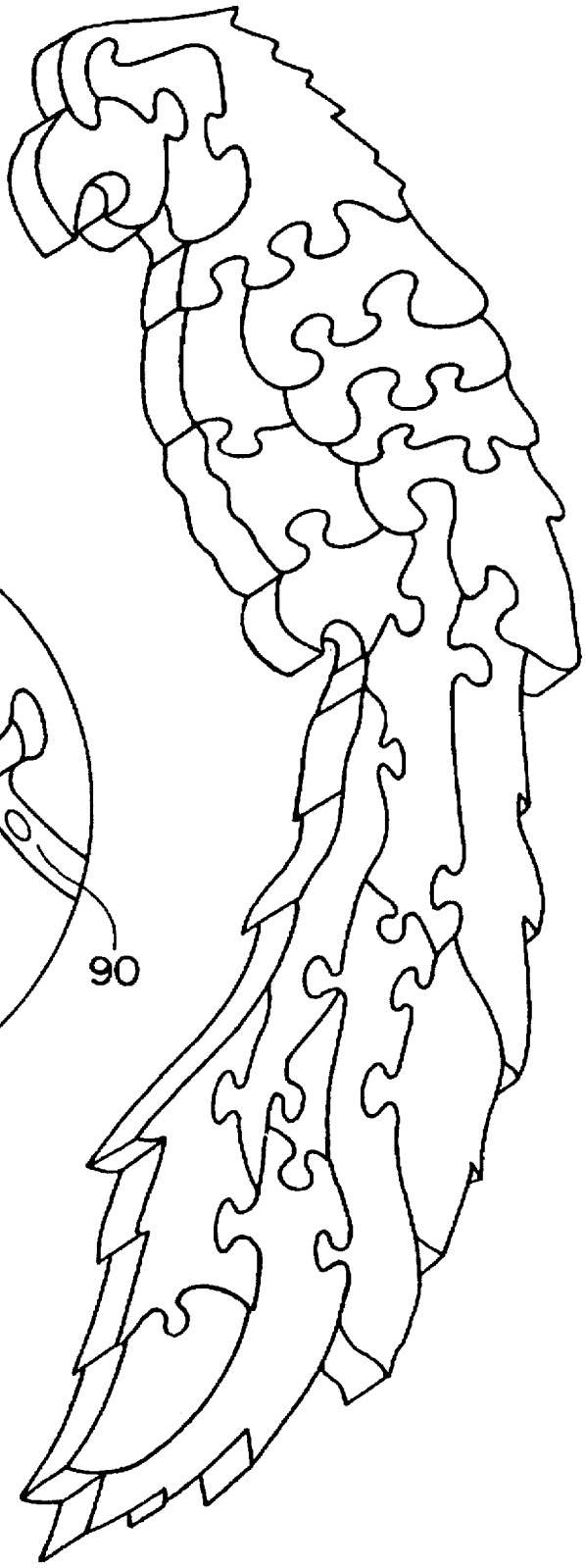

Another embodiment of the invention is shown in FIG. 5, wherein a plurality of compressible inserts 90, having a transverse width or diameter which is less than the thickness of the puzzle pieces 12, 14, 16, etc., are fixedly attached longitudinally to the inside mating surfaces of the puzzle pieces 12, 14, 16, etc., to provide a friction fit between the interlocking surfaces, thus frictionally securing the complementary puzzle pieces to prevent them from dislodging unless sufficient force is applied. In the preferred embodiment of the invention, the compressible inserts 90 are circular.

Figure 6A:
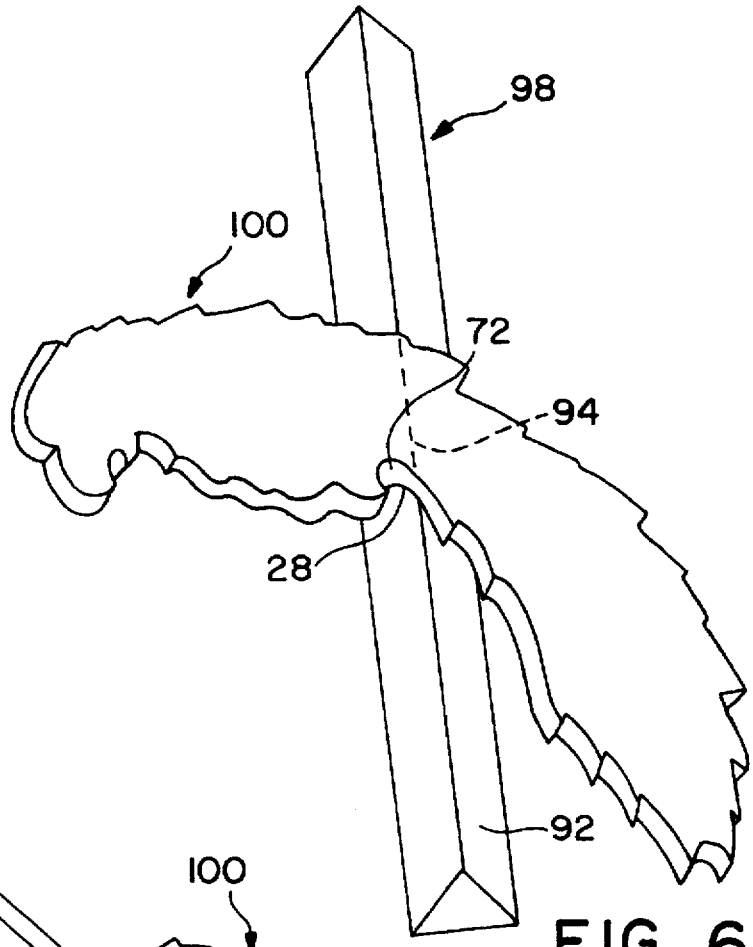
FIG. 6*a* is a silhouette drawing cut-out of the jigsaw puzzle sculpture placed horizontally on a knife-edge.
Figure 6B:
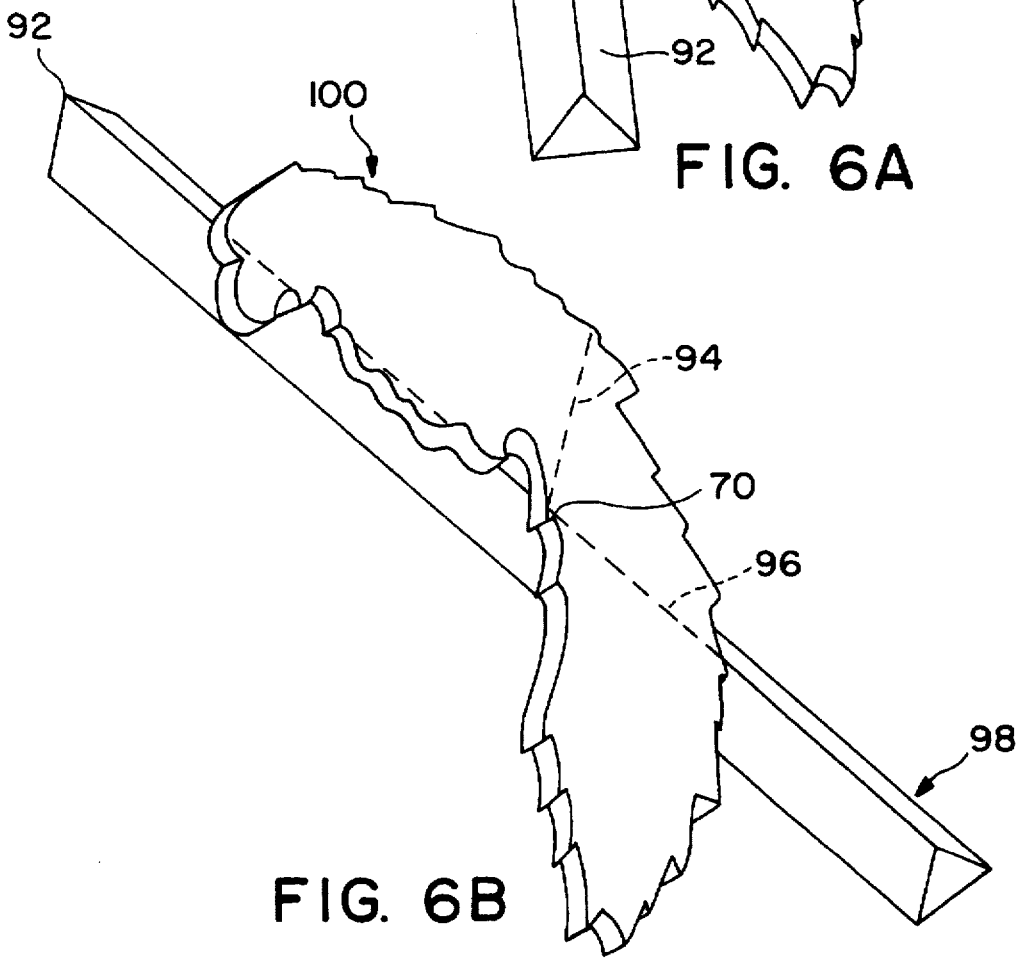
FIG. 6*b* is a silhouette drawing cut-out of the jigsaw puzzle sculpture placed in an alternate horizontal orientation from FIG. 6*a* on a knife-edge.

A method of making a self-balancing jigsaw puzzle is shown in FIGS. 6*a* and 6*b*. As previously shown in FIG. 2, the puzzle sculpture 100 has a suspension point 72 at the top center of the recess 28 which represents the natural perching point. The innovative feature is the placement of the puzzle sculpture's suspension point 72 at a point directly above the center of gravity 70 to allow the completed puzzle sculpture 100 to balance with the proper vertical orientation or posture.

First, a figure having a natural display balancing point is selected as a basis for the completed jigsaw puzzle sculpture 100. A silhouette or outline drawing of the selected figure, including its natural suspension point 72, is drawn in an upright position. The representation of the sculpture 100 is then cut from a substantially rigid material such as cardboard. With the puzzle FIG. 100 in a horizontal orientation, the center of gravity 70, or centered, is determined using a balancing procedure. The FIG. 100 is placed horizontally on a relatively thin vertical edge 92, such as the edge of a ruler or knife, which acts as a fulcrum 98 as shown in FIGS. 6*a* and 6*b*. When the FIG. 100 is balanced on the vertical edge 92 of the fulcrum 98, the line formed on the horizontal FIG. 100 and vertical edge 92 of the fulcrum 98 is the first balance line 94. The FIG. 100 is then rotated some arbitrary amount and the method is then repeated to find the second balancing line 96 as shown in FIG. 6*b*. The point at which the two balancing lines 94 and 96 intersect is the center of gravity 70 of the FIG. 100. All balancing lines pass through the center of gravity 70 of the FIG. 100, whether or not the balancing lines 94 and 96 are orthogonal.

The distance between the center of gravity 70 and the suspension point 72 is directly proportionate to the degree of stability of the assembled puzzle sculpture 100 when displayed in the preferred natural posture of the replicated figure. If the center of gravity 70 is too close to the suspension point 72, the puzzle will not maintain balance in the proper orientation. The lower the center of gravity 70 below the perching point 72, the greater the resistance to rotation on the horizontal rod member 80.

In the event the balancing lines 94 and 96 intersect at an orientation inappropriate to the suspension point 72, the sculpture 100 may be altered to redistribute the mass, thus shifting the center of gravity 70 to a point below the suspension point 72. The shape of the sculpture 100 is then systematically altered to create an optimum location for its suspension point 72 by adding and removing mass from the sculpture 100 while performing the balancing procedure and maintaining the sculpture's 100 overall characteristics. The resultant optimally balanced sculpture 100 is then cut into a plurality of puzzle pieces 12, 14, 16, etc., containing corresponding male projections 60 and female recesses 62 and defining anatomical, functional, or characteristic segments of the sculpture 100.

In the preferred embodiment of the invention, a computer drafting or Computer Aided Design software program is utilized to determine the center of gravity 72 and to distribute the mass as previously described. While the invention has been described by reference to preferred embodiments, this was for purpose of illustration only and should not be deemed to limit the scope of the invention. Numerous alternative embodiments will be apparent to those skilled in the art.

We claim:

1. A balancing jigsaw sculpture and support comprising:

a. a plurality of puzzle pieces containing male projections and female recesses such that a female recess is correspondingly shaped to a male projection of an adjacent puzzle piece to allow the plurality of pieces to interlock in a conventional manner wherein the outer peripheral edges of the assembled jigsaw puzzle forms the sculpture;

b. the assembled jigsaw puzzle sculpture having a predetermined center of gravity;

c. the sculpture having a suspension point defined by a recess in one of the puzzle pieces with the suspension point being located vertically above the predetermined center of gravity; and d. a support member for engaging the recess of the sculpture with the sculpture disposed in vertical orientation with respect to the support so that the sculpture balances for display on the support member.

2. A puzzle as claimed in claim 1 wherein the puzzle pieces are substantially thick to allow the pieces to be moved forward or backward in any combination to produce a three-dimensional effect.

3. A puzzle as in claim 1 further comprising a plurality of compressible inserts and an adhesive means for fixedly attaching the inserts longitudinally to the inside of the puzzle pieces to provide a friction fit between the interlocking puzzle pieces to prevent them from dislodging unless sufficient force is applied and wherein the compressible inserts have a transverse width which is less than the thickness of the puzzle pieces.

4. A puzzle as claimed in claim 3 wherein the inserts are a woven or non-woven fabric material.

5. A puzzle as claimed in claim 3 wherein the inserts are a synthetic material.

6. A balancing jigsaw sculpture as defined in claim 1 in which the plurality of puzzle pieces are fabricated from a material selected from the group consisting of wood, wood composite, polymer resin and foam.

7. A balancing jigsaw sculpture replicating a bird and a support for the sculpture comprising:

a. a plurality of puzzle pieces containing male projections and female recesses such that a female recess is correspondingly shaped to a male projection of an adjacent puzzle piece to allow the plurality of pieces to interlock in a conventional manner wherein the outer peripheral edges of the assembled jigsaw puzzle replicate a bird;

b. the assembled jigsaw puzzle sculpture having a predetermined center of gravity;

c. the sculpture having a suspension point defined by a recess replicating a bird's claws in one of the puzzle pieces with the suspension point being located vertically above the predetermined center of gravity; and d. a horizontal support member for engaging the recess of the sculpture replicating a bird's natural perching posture with the sculpture disposed in vertical orientation with respect to the support so that the sculpture balances for display on the support member.

8. A balancing jigsaw sculpture as defined in claim 7 in which puzzle pieces are made in the shape of anatomical parts and markings of a bird.

9. A balancing jigsaw sculpture as defined in claim 8 in which the puzzle pieces are colored to resemble a bird's feathers.

10. A method of making a balancing jigsaw puzzle comprising:

a. drawing a silhouette of a sculpture including its natural balancing point on a substantially rigid material;

b. cutting the sculpture along the peripheral lines;

c. determining the sculpture's center of gravity which is the intersection point of a first and a second balancing line by i. balancing the sculpture horizontally on the vertical edge of a fulcrum to find a first balancing line;

ii. rotating the sculpture to a different horizontal orientation; and iii. balancing the sculpture horizontally on the vertical edge of a fulcrum to find a second balancing line;

d. redistributing the sculpture's mass to shift the center of gravity to a point directly below the sculpture's suspension point; and e. cutting the sculpture to form a plurality of puzzle pieces containing corresponding male projections and female recesses.

11. A method of making a balancing jigsaw puzzle comprising:

a. drawing a silhouette of a sculpture including its natural balancing point on a substantially rigid material;

b. cutting the sculpture along the lines of the silhouette;

c. determining the sculpture's center of gravity at the intersection point of first and second balancing lines by i. balancing the sculpture horizontally on the vertical edge of a fulcrum to locate a first balancing line;

ii. rotating the sculpture to a different horizontal orientation on the fulcrum;

iii. balancing the sculpture horizontally on the fulcrum at said different horizontal orientation to locate a second balancing line;

d. selecting a suspension point for the sculpture at a location vertically above the center of gravity; and e. cutting the sculpture to form a plurality of jigsaw puzzle pieces containing male projections and female recesses such that a female recess is correspondingly shaped to a male projection of an adjacent puzzle piece to allow the plurality of pieces to interlock.

* * * * *